US010087060B2

(12) United States Patent
Hamlik et al.

(10) Patent No.: US 10,087,060 B2
(45) Date of Patent: Oct. 2, 2018

(54) SIDE SHIFTER WITH ACTUATOR EMBEDDED IN LOAD BEARING STRUCTURES OF THE SIDE SHIFTER

(71) Applicant: Rightline Equipment, Inc., Rainier, OR (US)

(72) Inventors: Jim D. Hamlik, Vancouver, WA (US); Joel D. Hamlik, Vancouver, WA (US)

(73) Assignee: Rightline Equipment, Inc., Rainer, OR (US)

( * ) Notice: Subject to any disclaimer, the term of this patent is extended or adjusted under 35 U.S.C. 154(b) by 232 days.

(21) Appl. No.: 14/898,731

(22) PCT Filed: Jun. 27, 2014

(86) PCT No.: PCT/US2014/044738
§ 371 (c)(1),
(2) Date: Dec. 15, 2015

(87) PCT Pub. No.: WO2014/210562
PCT Pub. Date: Dec. 31, 2014

(65) Prior Publication Data

US 2016/0152455 A1 Jun. 2, 2016

Related U.S. Application Data

(60) Provisional application No. 61/841,049, filed on Jun. 28, 2013, provisional application No. 61/861,994, filed on Aug. 3, 2013.

(51) Int. Cl.
*B66F 9/14* (2006.01)

(52) U.S. Cl.
CPC ..... *B66F 9/146* (2013.01); *B66F 9/148* (2013.01)

(58) Field of Classification Search
CPC .. B66F 9/14; B66F 9/141; B66F 9/142; B66F 9/143; B66F 9/144; B66F 9/146; B66F 9/148
USPC ..... 414/671
See application file for complete search history.

(56) References Cited

U.S. PATENT DOCUMENTS

| | | | | |
|---|---|---|---|---|
| 4,279,564 | A * | 7/1981 | Weinert | B66F 9/183 414/621 |
| 4,392,772 | A | 7/1983 | Reeves | |
| 4,406,575 | A | 9/1983 | Gaibler | |
| 4,960,357 | A * | 10/1990 | Laursen | B66F 9/142 414/667 |
| 5,707,201 | A | 1/1998 | Hamlik | |
| 5,807,060 | A | 9/1998 | Hamlik | |
| 5,913,654 | A | 6/1999 | Kaup | |
| 6,390,763 | B1 | 5/2002 | Prentice | |
| 7,588,409 | B2 | 9/2009 | Foroni | |
| 7,909,563 | B2 | 3/2011 | Prentice | |
| 2003/0156935 | A1 | 8/2003 | Mondani et al. | |

(Continued)

*Primary Examiner* — Glenn F Myers
(74) *Attorney, Agent, or Firm* — Rylander & Associates, PC; Philip R.M. Hunt

(57) ABSTRACT

A side shifter configured for use on a lift truck with an actuator of the side shifter embedded in and almost completely surrounded by the weight bearing components of the side shifter, particularly the fork base top bar and back carriage top bar. This arrangement provides additional protection to the actuator. Embedding the actuator in the weight bearing components of the side shifter also provides for a larger unobstructed view through the middle side shifter.

5 Claims, 16 Drawing Sheets

(56) References Cited

U.S. PATENT DOCUMENTS

| | | | | |
|---|---|---|---|---|
| 2007/0079558 | A1* | 4/2007 | Foroni | B66F 9/142<br>49/375 |
| 2008/0152471 | A1 | 6/2008 | Polvilampi | |

* cited by examiner

SIDE SHIFTER WITH ACTUATOR EMBEDDED IN LOAD BEARING STRUCTURES OF THE SIDE SHIFTER

CROSS-REFERENCE TO RELATED APPLICATION

The present application claims the benefit of, and priority to, U.S. Provisional Application No. 61/841,049 filed on 28 Jun. 2013, incorporated herein by reference. The present application also claims the benefit of, and priority to, U.S. Provisional Application No. 61/861,994 filed on 3 Aug. 2013, incorporated herein by reference.

FIELD OF THE INVENTION

The present invention relates to cargo handling equipment. More particularly, the present invention relates to side shifters for use primarily with forklift trucks.

BACKGROUND

Material handling vehicles such as forklift trucks are used to pick up and deliver loads between stations. A forklift truck typically has a mast, which supports a load lifting carriage that can be raised along the mast. The carriage normally carries a pair of forks that are maneuverable beneath the load prior to lifting the load.

For a variety of well-known reasons, it is desirable to be able to displace the forks laterally with respect to the carriage. For example, as the truck approaches a load, the forks may not be properly aligned with the load to be maneuvered under it. Rather than moving the entire truck, it may be preferable to laterally reposition the forks along the carriage.

A typical side shifter uses hydraulics for laterally displacing the forks with respect to the center line of the vehicle. The vehicle normally includes a truck carriage bar, which is fixed on the mast against lateral displacement, and the side shifter typically includes a shifter carriage, which is moveable laterally with respect to the truck carriage. The forks are mounted on the shifter carriage, and a hydraulic actuator connecting the truck carriage bar to the shifter carriage provides the shifting action.

SUMMARY AND ADVANTAGES

The actuator is the most critical component of any side shifter. Designers often choose to armor the actuator or place it where it is less likely to be damaged, but this can add weight and cost.

In the embodiments of the invention described herein, the actuator is embedded in and almost completely surrounded by the necessarily thick weight bearing components of the side shifter, particularly the fork base top bar and back carriage top bar. This arrangement provides additional protection to the actuator. Embedding the actuator in the weight bearing components of the side shifter also provides for a larger unobstructed view through the middle side shifter.

BRIEF DESCRIPTION OF THE DRAWINGS

The present invention will be described by way of exemplary embodiments, but not limitations, illustrated in the accompanying drawings in which like references denote similar elements, and in which.

The accompanying drawings, which are incorporated into and constitute a part of this specification, illustrate one or more embodiments of the invention and, together with the detailed description, serve to explain the principles and implementations of the invention.

DETAILED DESCRIPTION

Figure 1:
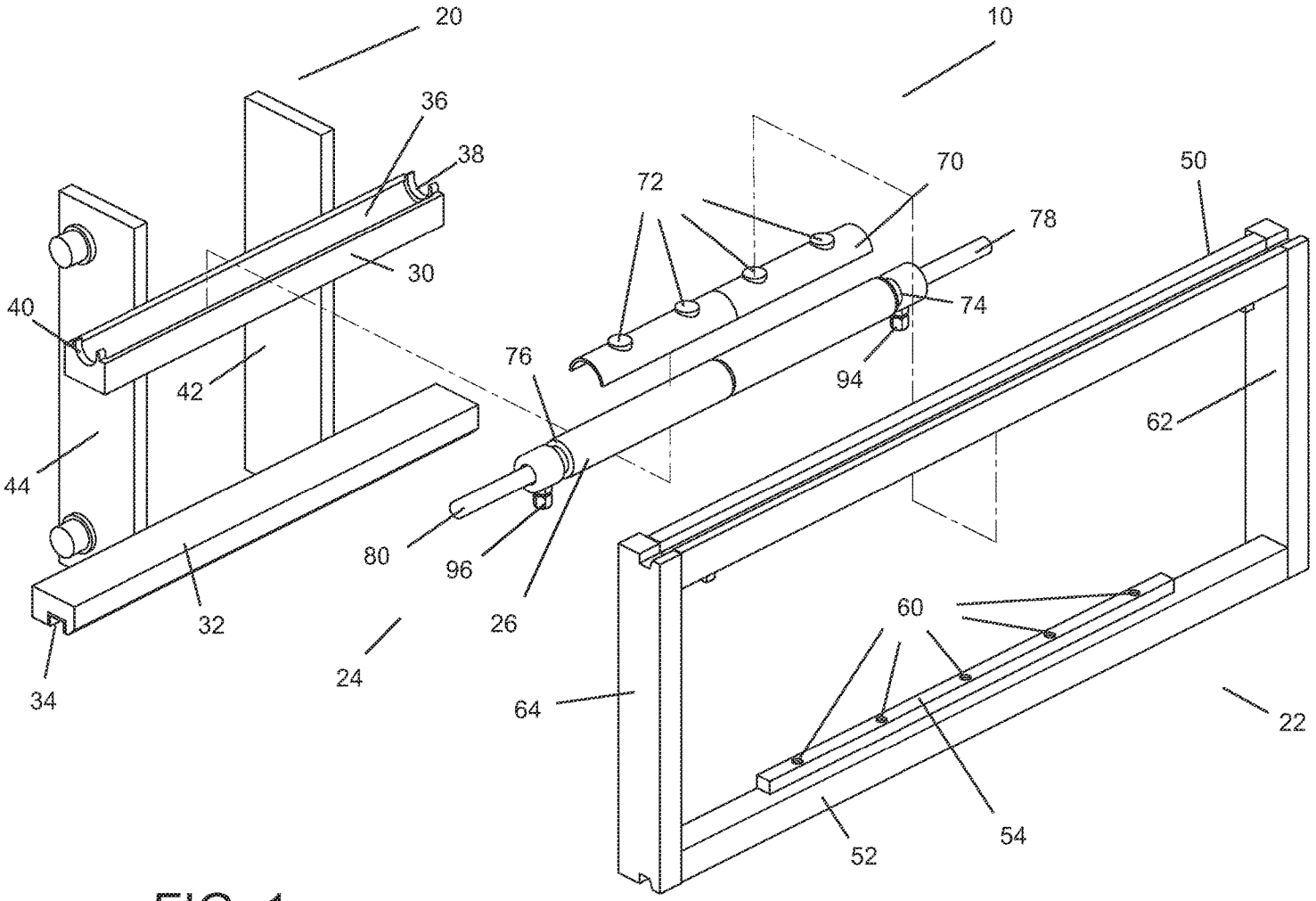
FIG. 1 is an exploded isometric front view of a first embodiment of the invention.

Before beginning a detailed description of the subject invention, mention of the following is in order. When appropriate, like reference materials and characters are used to designate identical, corresponding, or similar components in different figures. The figures associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Use of directional terms such as "upper," "lower," "above," "below", "in front of," "behind," etc. are intended to describe the positions and/or orientations of various components of the invention relative to one another as shown in the various Figures and are not intended to impose limitations on any position and/or orientation of any embodiment of the invention relative to any reference point external to the reference.

First Embodiment

FIGS. 1-4 show a first embodiment of a side shifter apparatus 10 that is configured to be attached to a lift truck (not shown). The lift truck may be used to lift and transport a load and the side shifter apparatus 10 provides the ability to move the load from side to side without moving the lift truck itself. The side shifter apparatus 10 includes a back carriage 20, a fork base 22 and an actuator 24. The back carriage 20 is configured to attach to a mast of the lift truck. The fork base 22 provides a base on which forks or other common forklift attachments may be attached. These attachments grasp or otherwise take hold of the load, allowing the load to be lifted. The actuator 24 is coupled to the back carriage 20 and to the fork base 22 in a manner that enables the actuator 24 to move the fork base 22 left and right relative to the back carriage 20. The actuator 24 not only serves to move the fork base 22 laterally, but also serves to transmit the force of the load from the fork base 22 to the back carriage 20. In the first embodiment, the actuator 24 is held by the back carriage 20, but in other embodiments the actuator 24 may be coupled to the back carriage 20 or to the fork base 22.

The actuator 24 has an actuator body 26, a right piston rod 78, a left piston rod 80, a right hydraulic connection 94 and a left hydraulic connection 96. The actuator 24 is configured to move the right piston rod 78 and left piston rod 80 in tandem, applying more or less the same amount of force in the same direction to each. The internal workings of the actuator 24 are similar to those described in U.S. Pat. No. 5,807,060, incorporated herein by reference. In the first embodiment, the actuator body 26 is cylindrical in shape, but in other embodiments may have a different shape.

The back carriage 20 has a top bar 30, bottom bar 32, right side bar 42 and left side bar 44. The side bars 42, 44 are configured to attach to the lift truck mast and provide a connection between the top bar 30 and bottom bar 32.

The back carriage top bar 30 is configured to receive the actuator body 26 and hold it in a fixed position relative to the back carriage 20. The back carriage top bar 30 has a recess 36 in its topside. The back carriage top bar recess 36 is concave and configured to contain a lower portion of the actuator body 26 within. Furthermore, the back carriage top bar recess 36 is shaped for the lower portion of the actuator body 26 to nest within. As used herein, "nest" means to fit at least a part of a first object within at least part of a second object with little or no clearance between the surface of that part of the first object and a corresponding surface of second object. The back carriage top bar recess 36 is configured for providing contact between the recess 36 and most of the lower portion of the actuator body 26 while enclosing most of the lower portion of the actuator body 26 within the back carriage top bar 30. In the first embodiment, the back carriage top bar recess 36 is semi-circular in cross-section but in other embodiments may have a different shape configured to nest with the shape of the actuator body 26. The back carriage top bar recess 36 is a load bearing surface, through which the weight of the load is transmitted vertically from the actuator body 26 to the back carriage top bar 30. In the first embodiment, the actuator body 26 does not move relative to the back carriage top bar 30, so the back carriage top bar recess 36 does not have to be lined with bearing material.

The back carriage top bar 30 has a right actuator retention tab 38 and a left actuator retention tab 40. These retention tabs 38, 40 hold the actuator body 26 in a fixed position so that it does not move relative to the back carriage 20.

The back carriage bottom bar 32 has a guide trough 34 on its underside. The guide trough 34 may be lined with bearing material, such as molybdenum disulfide-impregnated nylon.

The fork base 22 has a top bar 50, a bottom bar 52, a right bar 62, a left bar 64, and a guide bar 54. The fork base guide bar 54 is sized and shaped to slidingly engage with the back carriage guide trough 34. The fork base guide bar 54 and the back carriage bottom bar 32 act together to provide longitudinal support for the fork base 22, allowing the fork base 22 to move laterally relative to the back carriage 20, but not forward or back. The fork base guide bar 54 may comprise, or be covered with, bearing material, such as molybdenum disulfide-impregnated nylon. The guide bar 54 is attached to the upper side of the bottom bar 52 with guide bar bolts 60. The guide bar bolts 60 are inserted though the underside of the bottom bar 52 and thread into the guide bar 54. This arrangement allows for installation and removal of the fork base 22 to the back carriage 20.

The fork base top bar 50 has a recess 56 in its underside (see FIG. 4), making the fork base top bar 50 generally channel-shaped with the open side of the channel facing downward toward the fork base bottom bar 52. The fork base top bar recess 56 is concave and configured to contain an upper portion of the actuator body 26 within. Furthermore, the back carriage top bar recess 36 is shaped for the lower portion of the actuator body 26 to nest within. The fork base top bar recess 56 is configured for providing contact between the recess 56 and most of the upper portion of the actuator body 26. The fork base top bar recess 56 is longer than the actuator body 26, allowing the actuator body 26 to move laterally within the recess 56. In the first embodiment, the fork base top bar recess 56 is semi-circular in cross-section, but in other embodiments may have a different shape configured to nest with the shape of the actuator body 26. The fork base top bar recess 56 is a load bearing surface, through which the weight of the load is transmitted vertically from the fork base 22 to the actuator body 26.

At least a portion of the fork base top bar recess 56 is lined with a bearing material, such as molybdenum disulfide-impregnated nylon, to facilitate movement of the fork base 22 relative to the actuator body 26. In some embodiments, portions of the fork base top bar recess 56 near the ends may not be lined with bearing material. These portions near the ends of the fork base top bar recess 56 may have a larger cross-section and thus may not provide contact with the actuator body 26 if the actuator body 26 would move laterally past the bearing lined portions of the recess 56 into the unlined portions. This may be the case if the actuator body 26 is not designed to move all the way to the ends of the fork base top bar recess 56.

In the first embodiment, the fork base top bar 50 has a bearing 70 that is removable. The fork base top bar bearing 70 comprises bearing material, which may be backed by a layer of harder material. In the first embodiment, the fork base top bar bearing 70 has a length that is a portion of the length of the fork base top bar 50 and is sufficient to provide load bearing contact for the actuator body 26 over the full range of its designed lateral movement. The interior of the fork base top bar bearing 70 defines the margins of the fork base top bar recess 56 as far as the fork base top bar bearing 70 extends. In other embodiments, the fork base top bar bearing 70 extends for the full length of the fork base top bar 50. The fork base top bar bearing 70 has one or more bearing tabs 72 that are shaped to fit into indentations in the underside of the fork base top bar 50 and function to prevent lateral movement of the fork base top bar bearing 70. In some embodiments, the fork base top bar has more than one fork base top bar bearing 70.

The actuator body 26 is load bearing and is strongly engineered to bear the load forces transmitted from the fork base 22 to the back carriage 20 through the actuator body 26. Strengthening the actuator body 26 for this purpose achieves a synergy, since the actuator body 26 already must be strongly build to contain high pressure hydraulic fluid within the actuator body 26. The overall side shifter apparatus 10 uses less materials, resulting in lower weight and cost.

In the first embodiment, the right piston rod 78 is connected to a right thrust bracket 90, which is part of the fork base top bar 50 either integrally or by attachment. Similarly, the left piston rod 80 is connected to a left thrust bracket 92, which is part of the fork base top bar 50. The thrust brackets 90, 92 may function to provide limits of travel for the fork base 22. In some embodiments the right piston rod 78 is connected to the fork base right bar 62 and the left piston rod 80 is connected to the fork base left bar 64 and the thrust brackets 90, 92 are omitted.

In the first embodiment, the actuator body 26 is cylindrical in shape. However, in other embodiments, the actuator body 26 may have a square cross-section or some other shape. In these embodiments, the fork base top bar recess 56 and the back carriage top bar recess 36 will be shaped to match the actuator body 26, allowing the actuator body 26 to nest therein and provide load bearing contact.

The actuator body 26 has a right actuator retention slot 74 and a left actuator retention slot 76. The right actuator retention slot 74 and the left actuator retention slot 76 engage with the right actuator retention tab 38 and left actuator retention tab 40, respectively. These parts hold the actuator body 26 in place in the back carriage top bar recess 36 and prevent the actuator body 26 from moving laterally relative to the back carriage 20.

Figure 2:
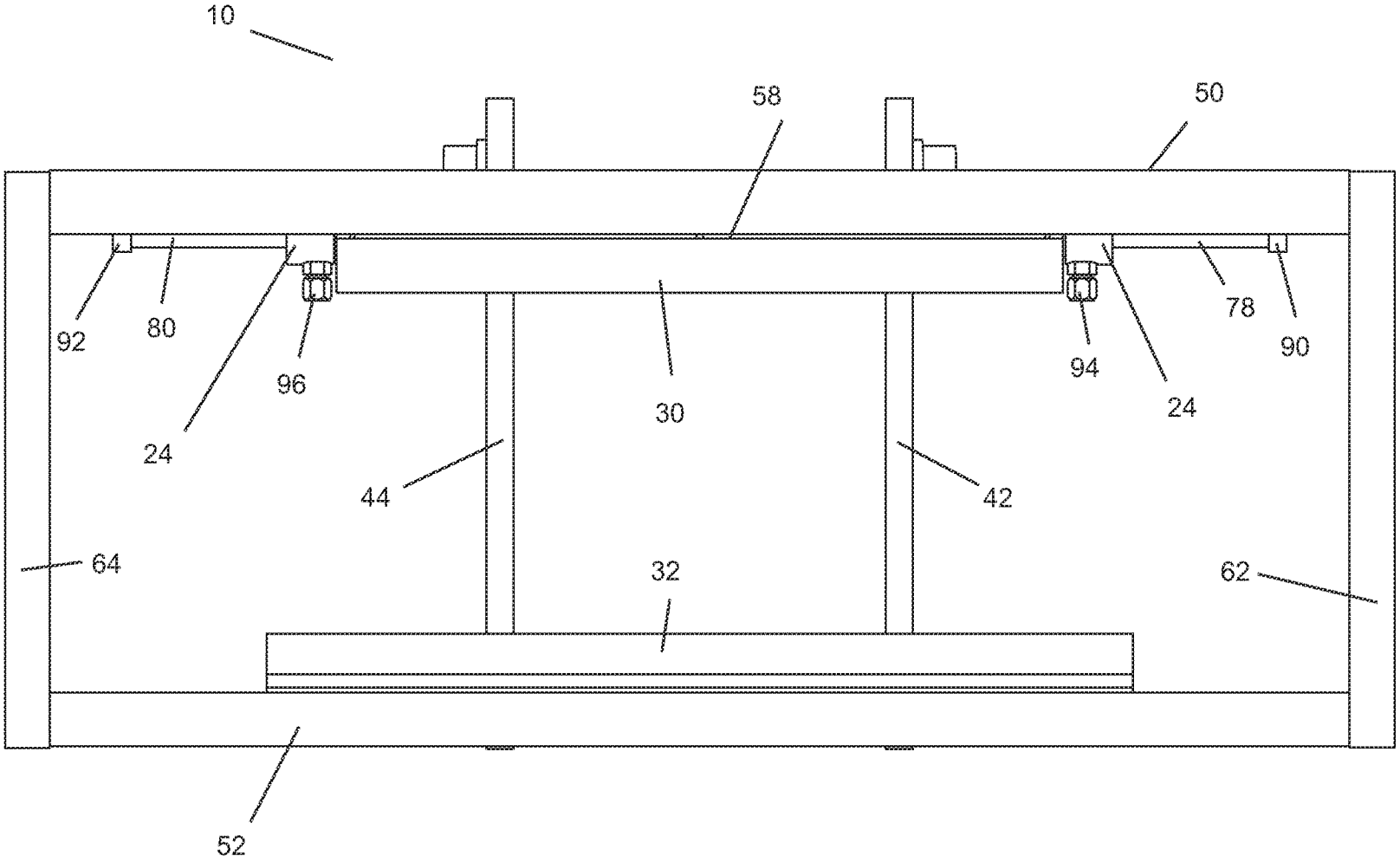
FIG. 2 is a front view of the first embodiment.
Figure 3:
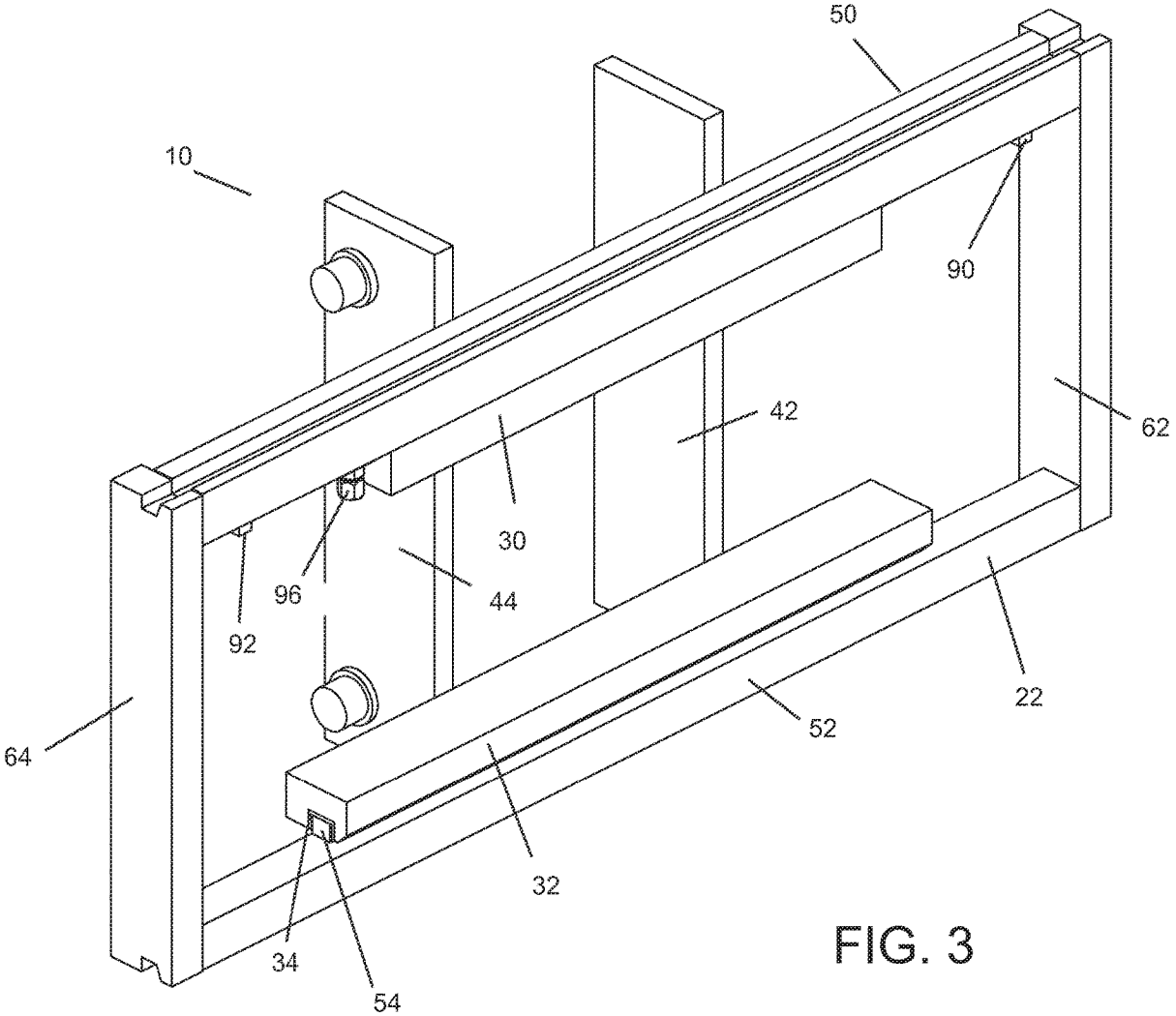
FIG. 3 is an isometric front view of the first embodiment.
Figure 4:
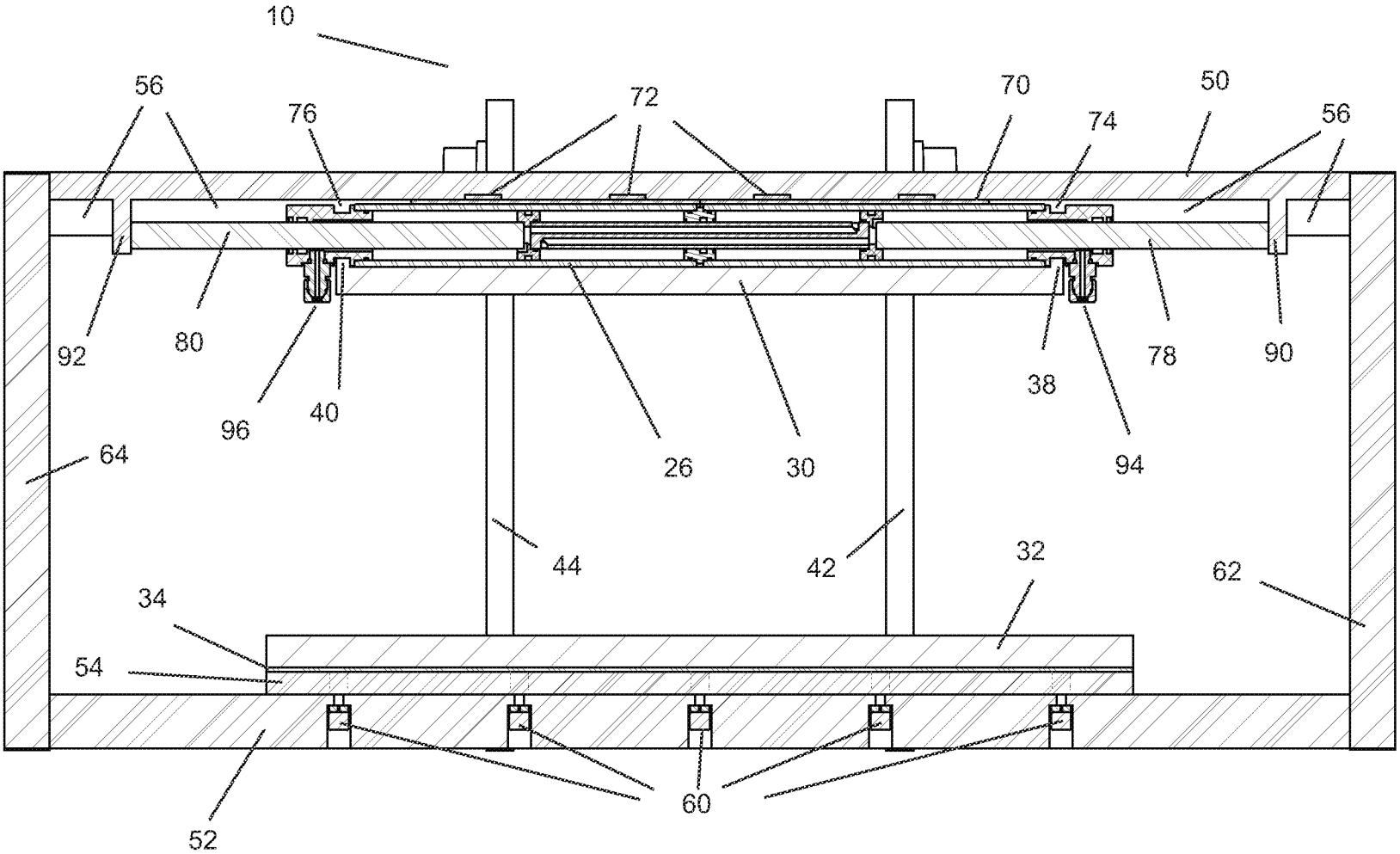
FIG. 4 is a cut-away front view of the first embodiment.

In the first embodiment, the back carriage top bar 30 and the fork base top bar 50 are shaped and sized so that a small gap 58 exists between them (see FIG. 2). This gap 58 is large enough to prevent contact between the back carriage top bar 30 and the fork base top bar 50, but small enough so that these parts still provide cover and protection for the actuator 24. In this inventive arrangement, the actuator 24 is additionally protected by being substantially (almost completely) enclosed by (surrounded by) the fork base top bar 50 and back carriage top bar 30. The small gap 58 exposes a small middle portion between the upper portion and lower portion of the actuator body 26. In the first embodiment, the upper portion and lower portion of the actuator body 26 are each just under half of the actuator body 26, but in other embodiments one may be over half of the actuator body 26 and the other substantially less than half. In some embodiments, the fork base top bar 50 is configured so that more than half of the actuator body 26, all of the left piston rod 80 and all right piston rod 78 are with within the fork base top bar recess 56.

In the first embodiment, the actuator body 26 has an outer surface of polished metal. This polished metal surface facilitates movement against the bearing material of the fork base top bar bearing 70. In other embodiments, the actuator body 26 may have different surface treatment.

In operation, the actuator 24 moves the piston rods 78, 80 in tandem either to the left or to the right. One of the piston rods 78, 80 pushes and the other pulls on the respective thrust brackets 90, 92. This causes the fork base 22 to move laterally, the bearing material in the recess 56 of the fork base top bar 50 sliding over the actuator body 26. At the same time, the fork base guide bar 54 moves laterally through the back carriage guide trough 34, preventing motion in the forward and backwards directions, but transferring little or no load force.

Second Embodiment

FIGS. 5-8 show a second embodiment of a side shifter apparatus 110. Like the side shifter in the first embodiment, it is configured to be attached to a lift truck (not shown). The second embodiment side shifter apparatus 110 includes a back carriage 120, a fork base 122 and an actuator 124. The components of the second embodiment of the side shifter apparatus 110 are similar in structure and function to corresponding parts in the first embodiment, unless noted herein. The primary difference between the first and second embodiments being that the actuator 124 in the second embodiment does not transmit the force of the load from the fork base 122 to the back carriage 120.

Similar to the first embodiment, in the second embodiment, the actuator 124 has an actuator body 126, a right piston rod 178, a left piston rod 180, a right hydraulic connection 194 and a left hydraulic connection 196. The actuator 124 is configured to move its right piston rod 178 and left piston rod 180 in tandem, applying more or less the same amount of force in the same direction to each. The internal workings of the actuator 124 are similar to those described in U.S. Pat. No. 5,807,060.

Similar to the first embodiment, in the second embodiment, the back carriage 120 has a top bar 130, bottom bar 132, right side bar 142 and left side bar 144. The side bars 142, 144 are configured to attach to the lift truck mast and provide a connection between the top bar 130 and bottom bar 132.

The back carriage top bar 130 is configured to receive the actuator body 126 and hold it in a fixed position relative to the back carriage 120. The back carriage top bar 130 has a recess 136 in its topside. The back carriage top bar recess 136 is concave and shaped to cradle the actuator body 126, providing contact between the back carriage top bar recess 136 and a substantial portion of the actuator body 126. In the second embodiment, the back carriage top bar recess 136 is semi-circular in cross-section and provides contact to most of the lower half of the actuator body 126.

The back carriage top bar 130 has a right actuator retention tab 138 and a left actuator retention tab 140. These retention tabs 138, 140 hold the actuator body 126 in a fixed position so that it does not move relative to the back carriage 120.

The back carriage bottom bar 132 has coupled to its front side one or more back carriage bottom bar bearings 146. The back carriage bottom bar bearings 146 may be surfaced with bearing material, such as molybdenum disulfide-impregnated nylon. The back carriage bottom bar bearings 146 facilitate the sliding of the fork base bottom bar 152 laterally across the front of the back carriage bottom bar 132.

The fork base 122 has a top bar 150, a bottom bar 152, a right bar 162, and a left bar 164. The bottom bar 152 has an indentation 172 that delimits a guide bar 154 in the bottom bar 152. The fork base guide bar 154 is configured to slidingly engage with a fork base bottom bearing 168. The fork base bottom bearing 168 may comprise, or be covered with, bearing material, such as molybdenum disulfide-impregnated nylon. The fork base bottom bearing 168 is held in contact with the fork base guide bar 154 by a fork base clamp 166. The fork base guide bar 154, the fork base bottom bearing 168 and the fork base clamp 166 act together to provide longitudinal support for the fork base 122, allowing the fork base 122 to move laterally relative to the back carriage 120, but not forward or back. The fork base clamp 166 is coupled to the back carriage bottom bar 132 with clamp bolts 160. This arrangement allows for installation and removal of the fork base 122 to the back carriage 120.

The fork base top bar 150 has a recess 156 in its underside (see FIG. 8), making the fork base top bar 150 generally channel-shaped with the open side of the channel facing downward toward the fork base bottom bar 152. In the second embodiment, the fork base top bar recess 156 is concave and shaped to contain an upper portion of the actuator body 126. In the second embodiment, the actuator body 126 is not in direct contact with the fork base top bar 150. The fork base top bar recess 156 is longer than the actuator body 126, allowing the actuator body 126 to move laterally within the recess 156. In the second embodiment, the fork base top bar recess 156 is semi-circular in cross-section, but in other embodiments may have differently shaped cross-sections.

Figure 5:
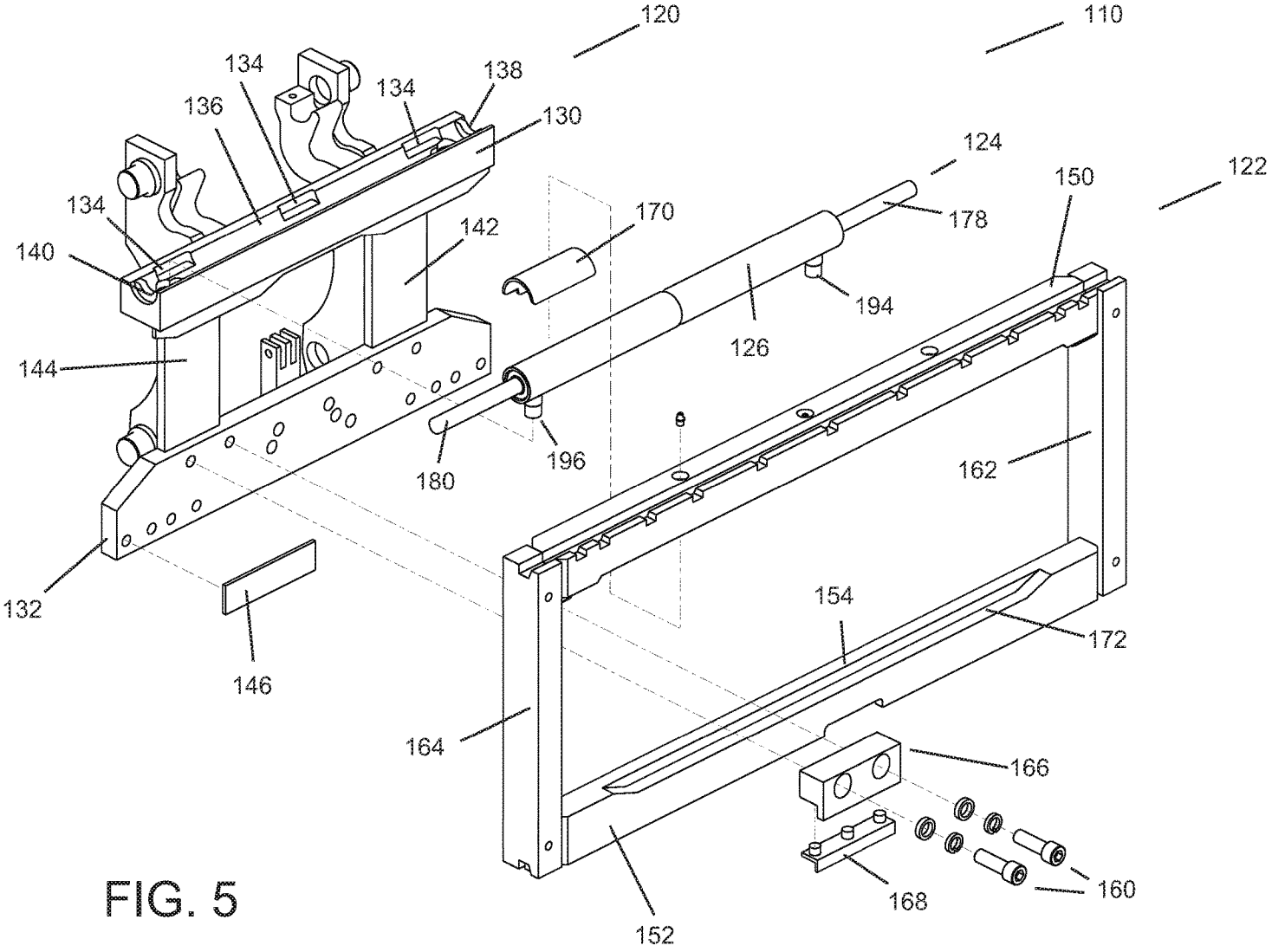
FIG. 5 is an exploded isometric front view of a second embodiment of the invention.

The second embodiment of the side shifter apparatus 110 has one or more top bar bearings 170, preferably three (only one is shown in FIG. 5 for clarity). The one or more top bar bearings 170 are configured to fit in a space between the actuator body 126 and the fork base top bar 150. The back carriage top bar 130 has a matching number of bearing retention slots 134. Each of the one or more top bar bearings 170 is configured to nest into one of the bearing retention slots 134, which prevent lateral movement of the top bar bearings 170. The one or more top bar bearings 170 are configured to transmit the force of a load from the fork base 122 to the back carriage 120 without transmitting any significant part of the force of the load through the actuator body 126. The one or more top bar bearings 170 provide a sliding surface for the fork base top bar 150. The one or more top bar bearings 170 comprise bearing material on their upper surfaces, and are backed by a layer of harder and stronger material.

In the second embodiment, the right piston rod 178 is connected to a right thrust bracket 190, which is part of the fork base top bar 150 either integrally or by attachment. Similarly, the left piston rod 180 is connected to a left thrust bracket 192, part of the fork base top bar 150. The thrust brackets 190, 192 may function to provide limits of travel for the fork base 122. In some embodiments the right piston rod 178 is connected to the fork base right bar 162 and the left piston rod 180 is connected to the fork base left bar 164 and the thrust brackets 190, 192 are omitted.

In the second embodiment, the actuator body 126 is cylindrical in shape. However, in other embodiments, the actuator body 126 may have a square cross-section or some other shape. In these embodiments, the fork base top bar recess 156, the top bar bearing 170, and the back carriage top bar recess 136 will be shaped to accommodate the actuator body 126.

Figure 6:
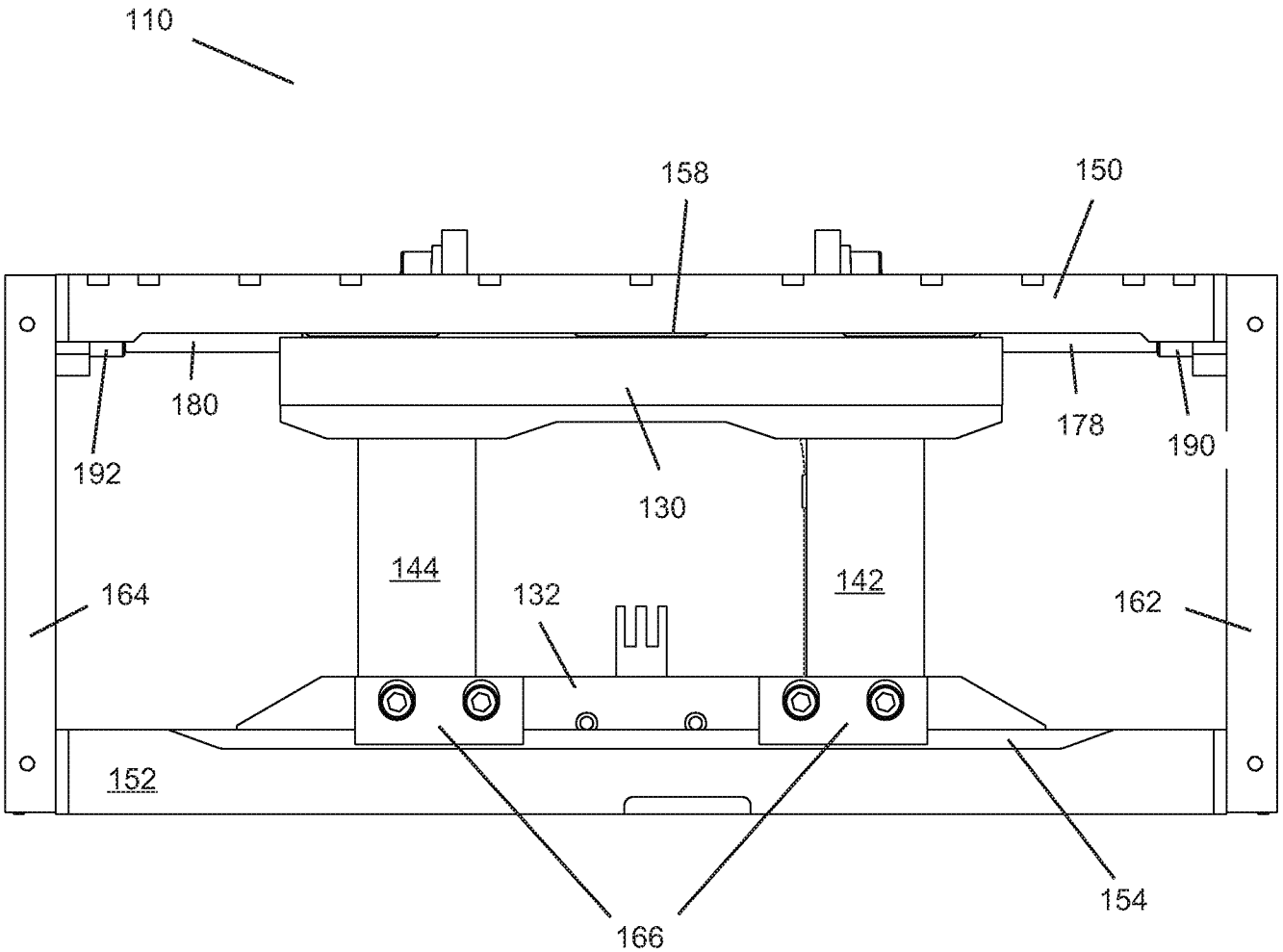
FIG. 6 is a front view of the second embodiment.
Figure 7:
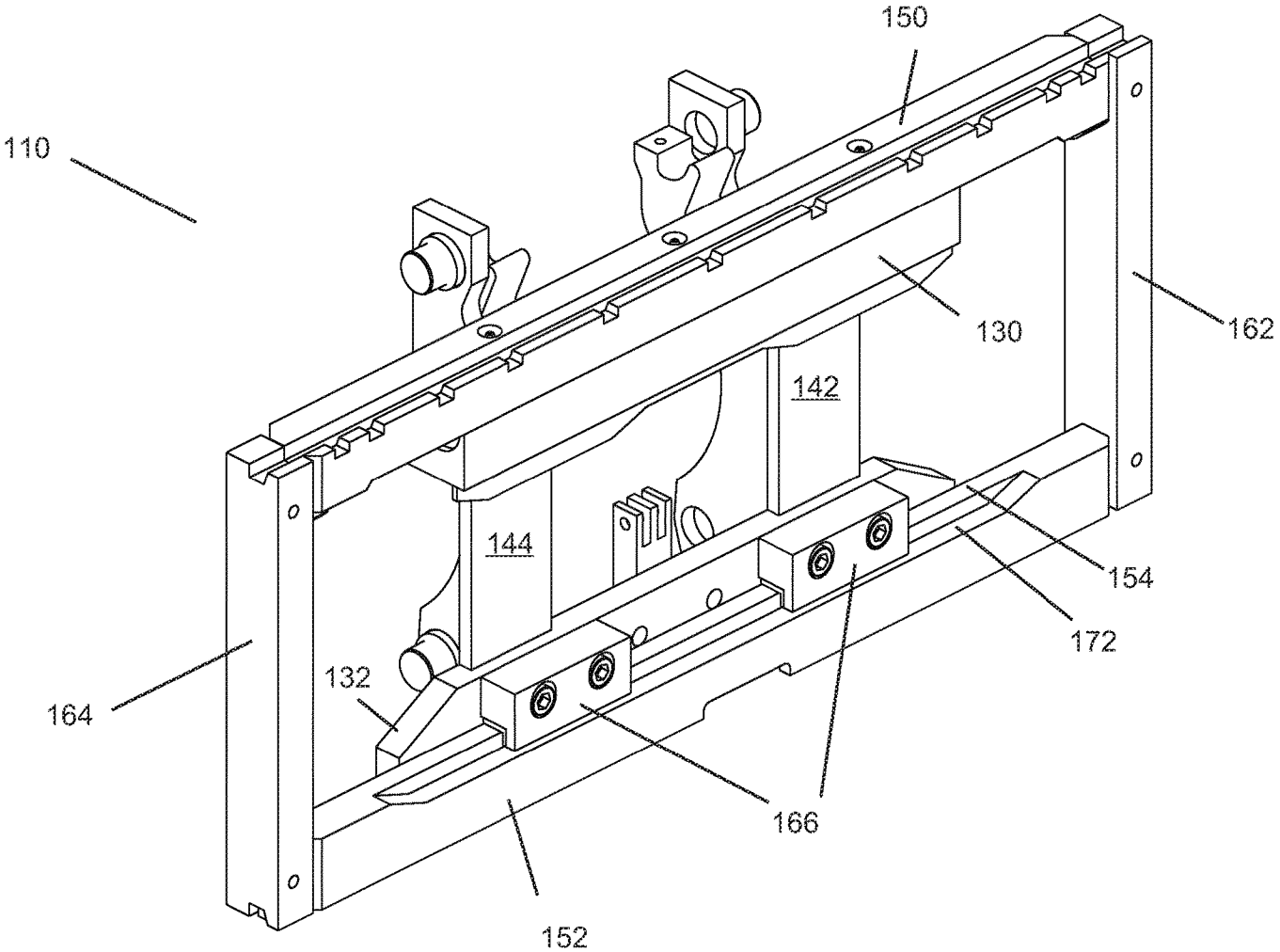
FIG. 7 is an isometric front view of the second embodiment.
Figure 8:
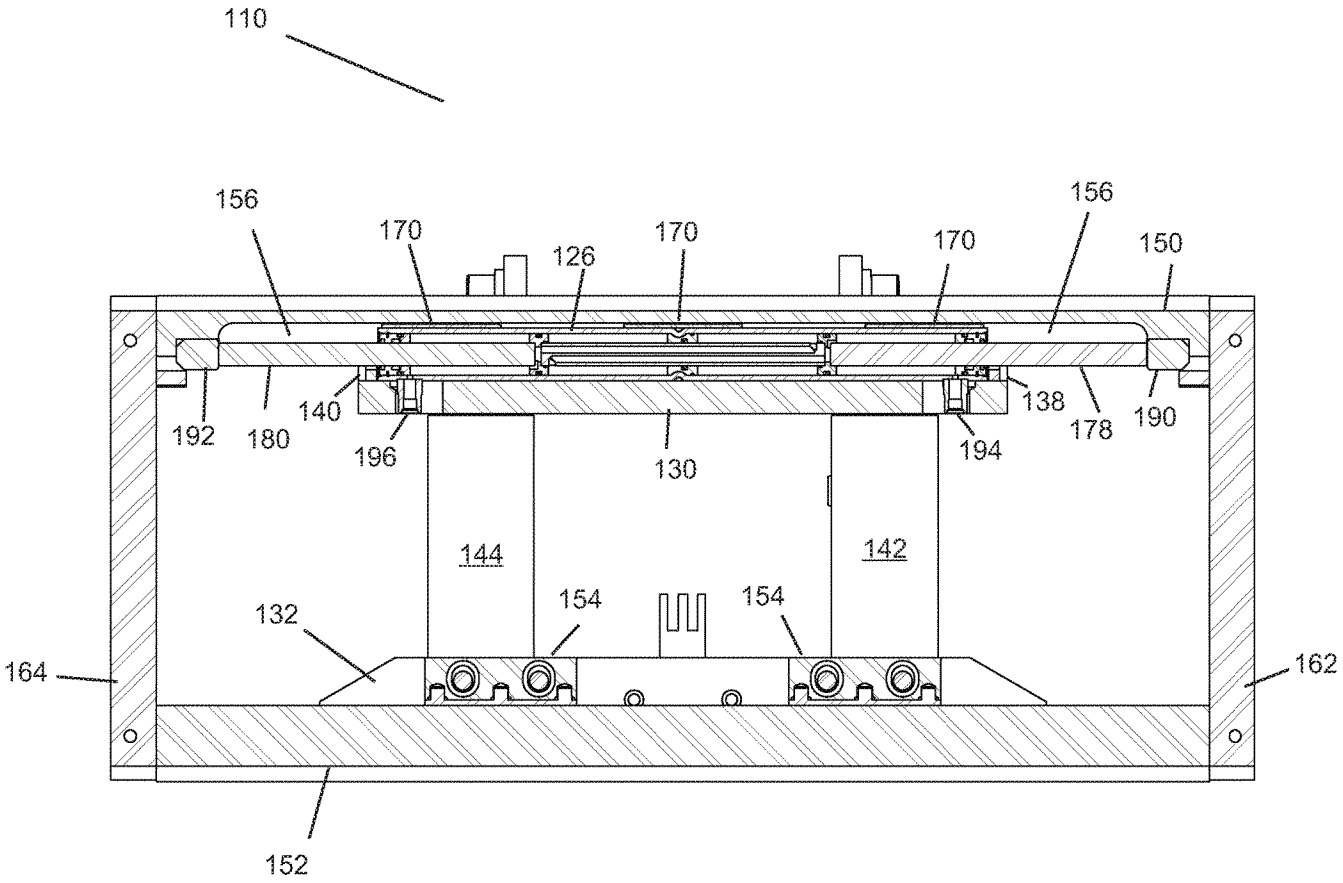
FIG. 8 is a cut-away front view of the second embodiment.

In the second embodiment, the back carriage top bar 130 and the fork base top bar 150 are shaped and sized so that a small gap 158 exists between them (see FIG. 6). This gap 158 is large enough to prevent contact between the back carriage top bar 130 and the fork base top bar 150, but small enough so that these parts still provide cover and protection for the actuator 124. In this inventive arrangement, the actuator body 126 is protected by being almost completely surrounded by the fork base top bar 150 and back carriage top bar 130.

In operation, the actuator 124 moves its piston rods 178, 180 in tandem either to the left or to the right. One of the piston rods 178, 180 pushes and the other pulls on the respective thrust brackets 190, 192. This causes the fork base 122 to move laterally, the fork base top bar 150 sliding over the one or more top bar bearings 170. At the same time, the fork base guide bar 154 moves laterally, with the fork base bottom bearing 168 and fork base clamp 166 preventing motion in the forward and backwards directions, but transferring little or no load force.

Third Embodiment

FIGS. 9-12 show a third embodiment of a side shifter apparatus 210. Like the side shifter in the first and second embodiments, it is configured to be attached to a lift truck (not shown). The third embodiment side shifter apparatus 210 includes a back carriage 220, a fork base 222 and an actuator 224. The components of the third embodiment of the side shifter apparatus 210 are similar in structure and function to corresponding parts in the second embodiment, unless noted herein. The primary difference between the second and third embodiments being the placement of bearings.

Similar to the second embodiment, in the third embodiment, the actuator 224 has an actuator body 226, a right piston rod 278, and a left piston rod 280. The actuator 224 is configured to move the right piston rod 278 and left piston rod 280 in tandem, applying more or less the same amount of force in the same direction to each. The internal workings of the actuator 224 are similar to those described in U.S. Pat. No. 5,807,060.

Similar to the second embodiment, in the third embodiment, the back carriage 220 has a top bar 230, bottom bar 232, right side bar 242 and left side bar 244. The side bars 242, 244 are configured to attach to the lift truck mast and provide a connection between the top bar 230 and bottom bar 232.

The back carriage top bar 230 is configured to receive the actuator body 226 and hold it in a fixed position relative to the back carriage 220. The back carriage top bar 230 has a recess 236 in its topside. The back carriage top bar recess 236 is concave and shaped to cradle the actuator body 226.

The back carriage top bar 230 has a right actuator retention tab 238 and a left actuator retention tab 240. These retention tabs 238, 240 hold the actuator body 226 in a fixed position so that it does not move relative to the back carriage 220.

The fork base 222 has a top bar 250, a bottom bar 252, a right bar 262, and a left bar 264. The fork base top bar 250 has a recess 256 in its underside (see FIG. 12), making the fork base top bar 250 generally channel-shaped with the open side of the channel facing downward toward the fork base bottom bar 252. In the third embodiment, the fork base top bar recess 256 is concave and shaped to contain an upper portion of the actuator body 226. In the third embodiment, the actuator body 226 is not in direct contact with the fork base top bar 250. The fork base top bar recess 256 is longer than the actuator body 226, allowing the actuator body 226 to move laterally within the recess 256.

Figure 9:
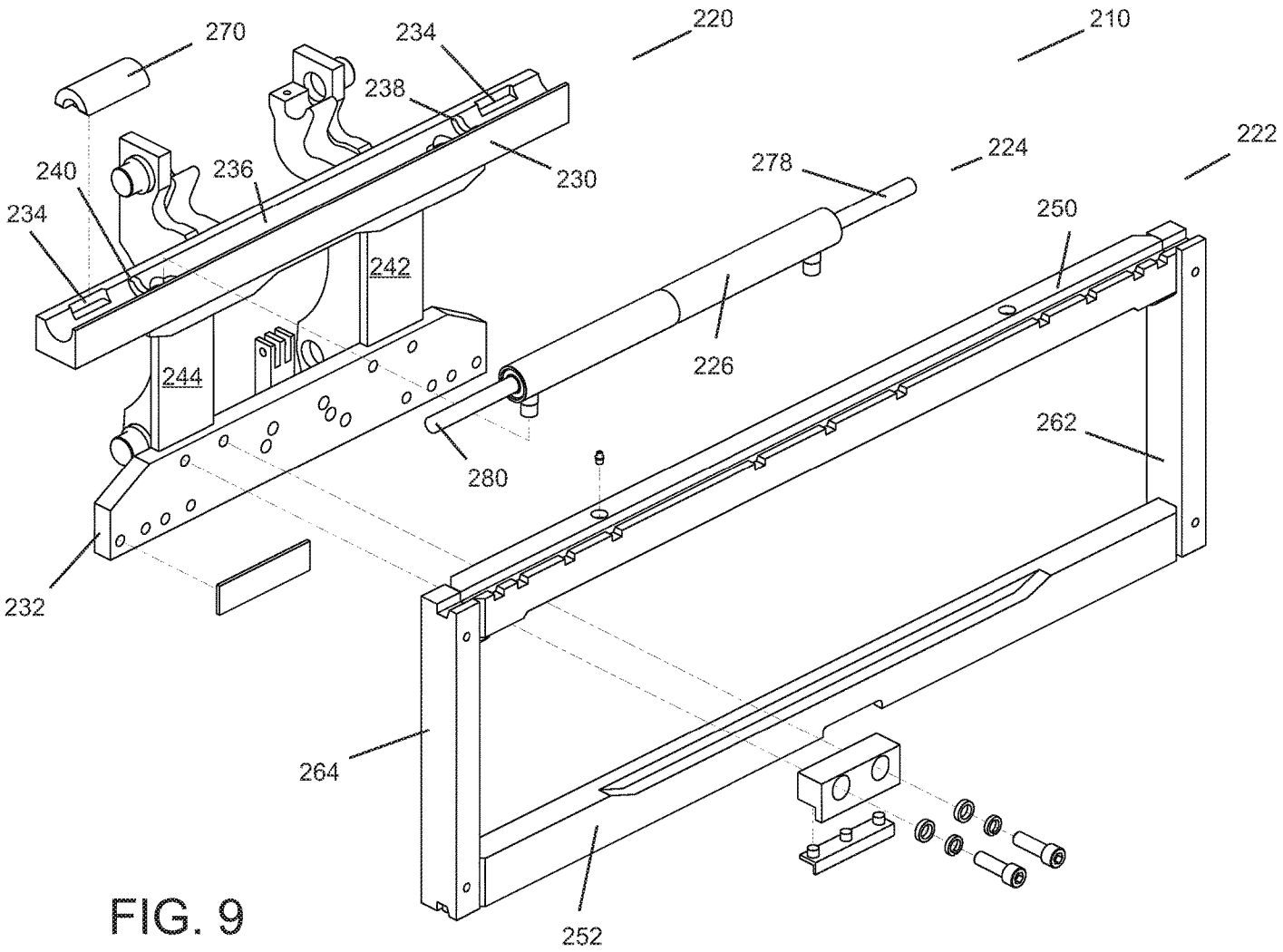
FIG. 9 is an exploded isometric front view of a third embodiment of the invention.
Figure 10:
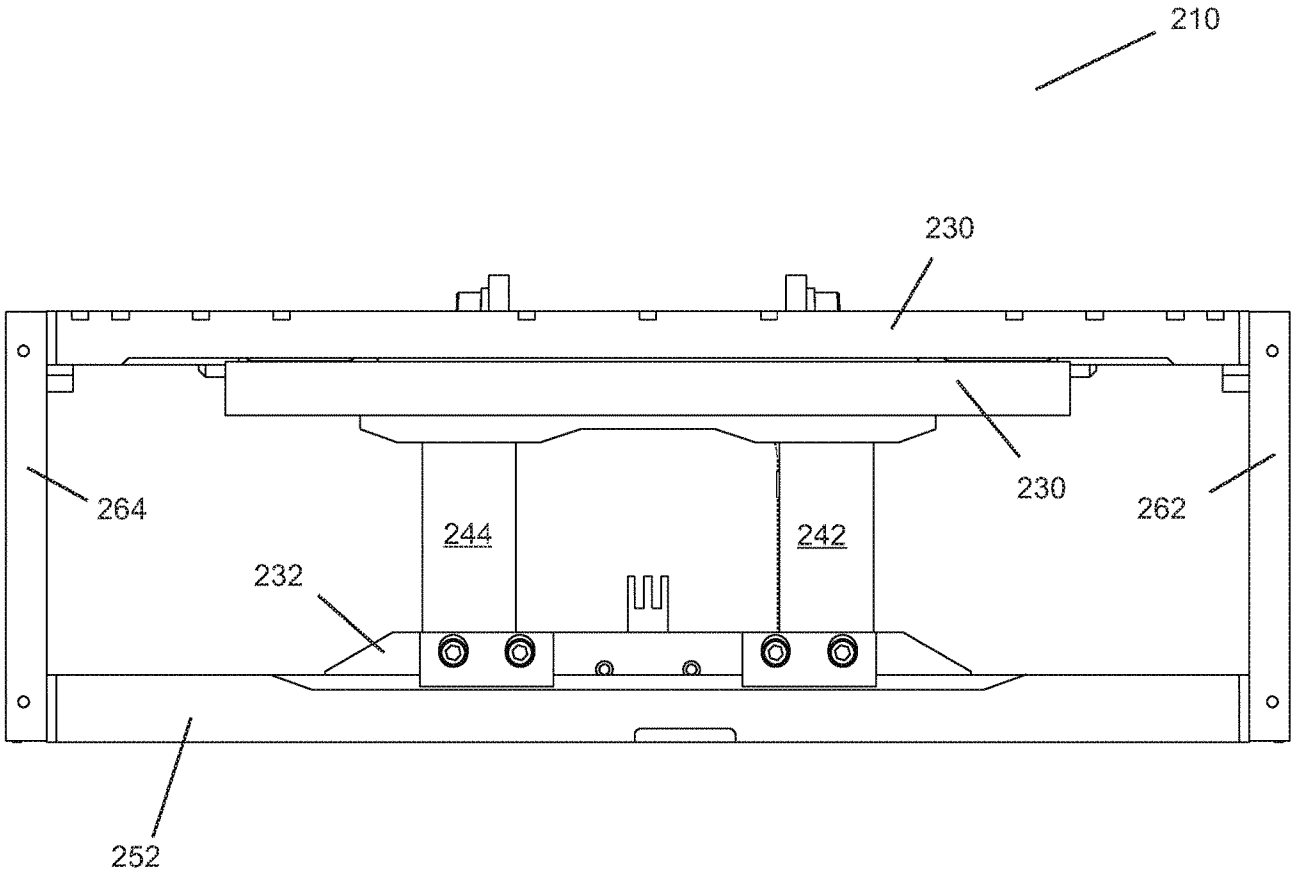
FIG. 10 is a front view of the third embodiment.
Figure 11:
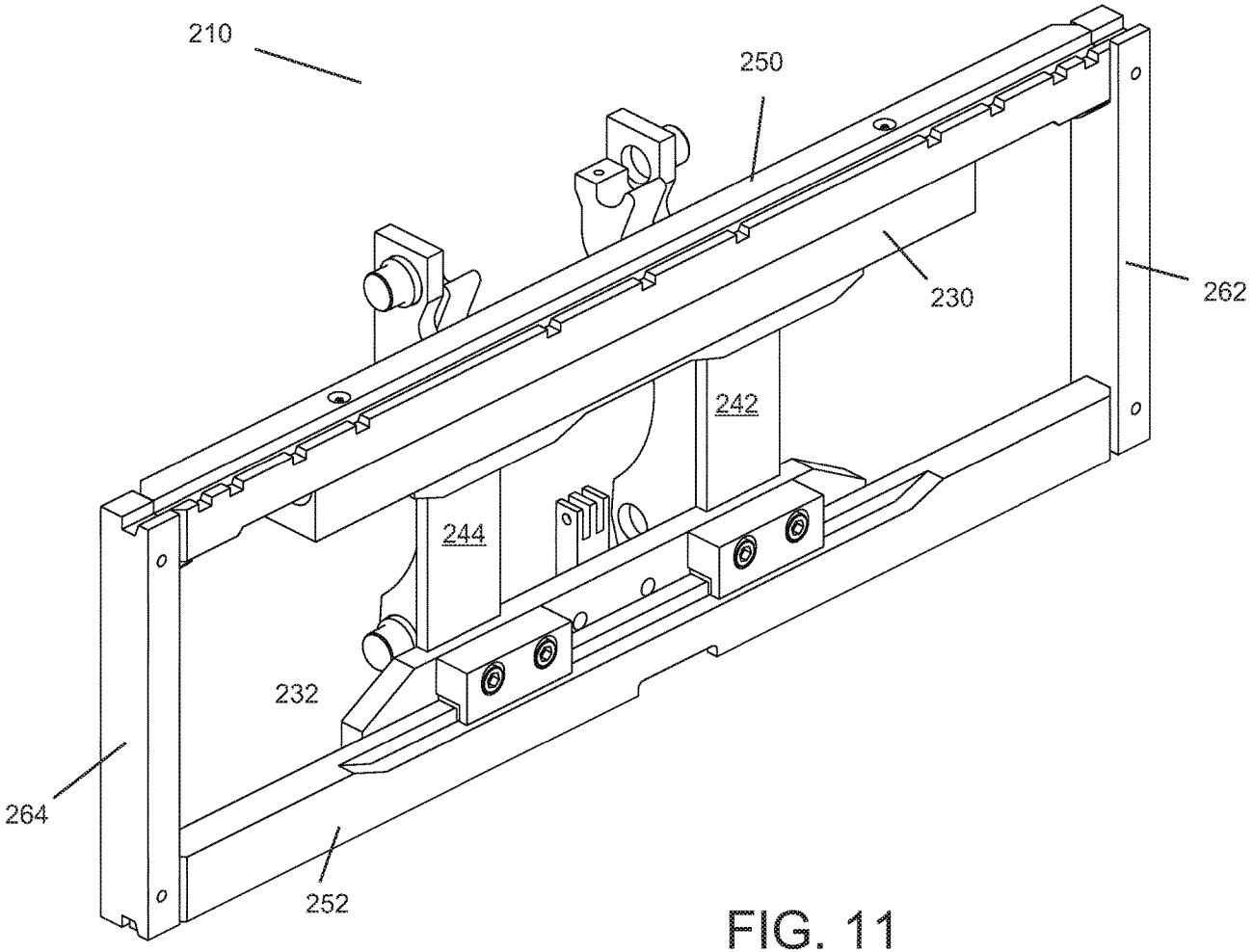
FIG. 11 is an isometric front view of the third embodiment.
Figure 12:
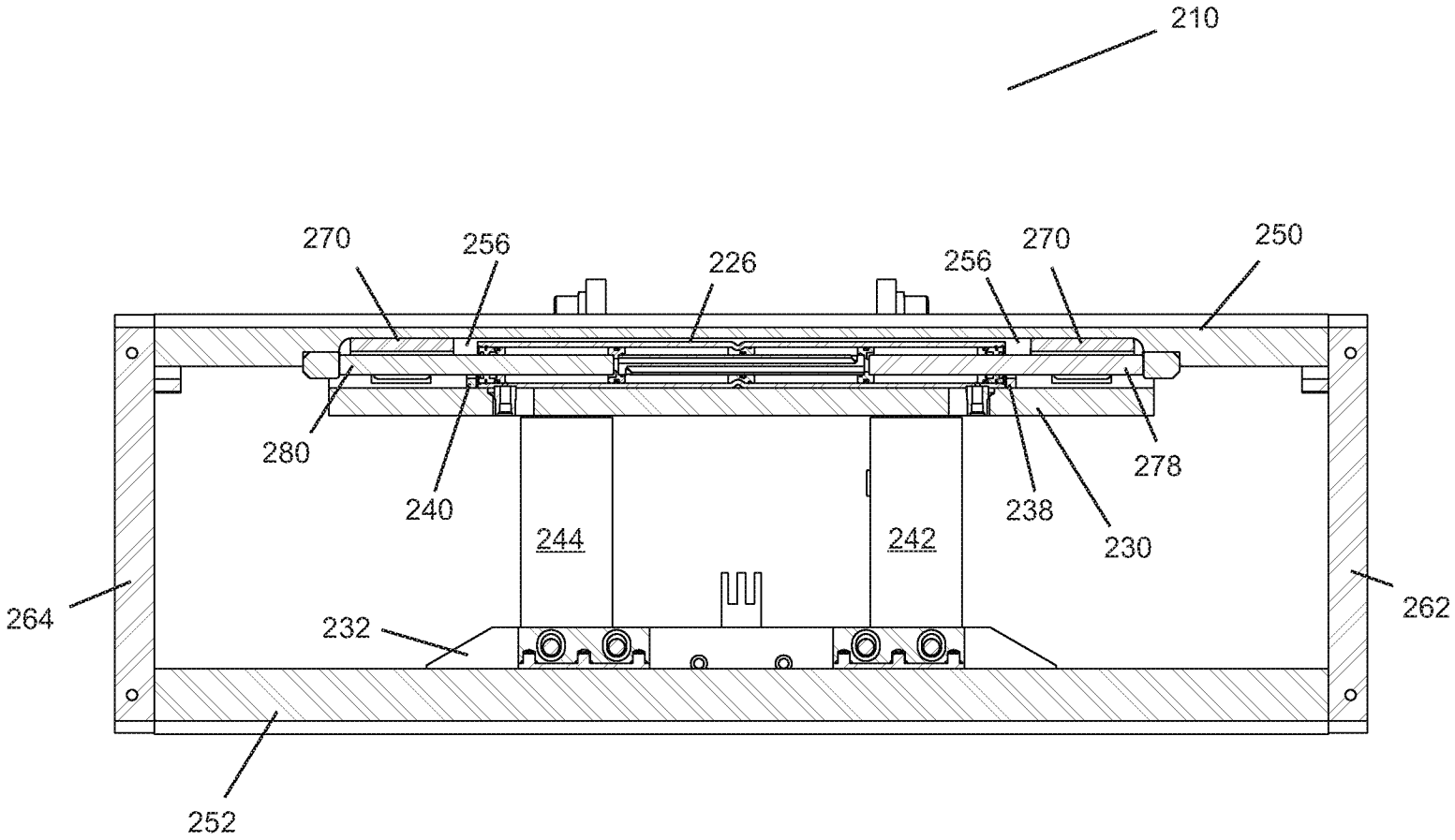
FIG. 12 is a cut-away front view of the third embodiment.

The third embodiment of the side shifter apparatus 210 has two or more top bar bearings 270, preferably two (only one is shown in FIG. 9 for clarity). The top bar bearings 270 are configured to fit in the fork base top bar recess 256 (see FIG. 12), at least one on each side of the actuator body 226, over the piston rods 278, 280. The back carriage top bar 230 has a matching number of bearing retention slots 234. Each of the top bar bearings 270 is configured to nest into one of the bearing retention slots 234, which prevent lateral movement of the top bar bearings 270. The one or more top bar bearings 270 are configured to transmit the force of a load from the fork base 222 to the back carriage 220 without transmitting any substantial part of the force of the load through the actuator body 226 or the piston rods 278, 280. The one or more top bar bearings 270 provide a sliding surface for the fork base top bar 250, allowing it to move laterally. The one or more top bar bearings 270 comprise bearing material on their upper surfaces, and are backed by a layer of harder and stronger material.

Since unlike the second embodiment, the top bar bearings 270 in the third embodiment are not over the actuator body 226, but rather over the piston rods 278, 280, the outside dimensions of the top bar bearings 270 may be smaller, even if they are just as strong as the top bar bearings 170 in the second embodiment. This permits the fork base top bar recess 256 to have smaller dimensions, which in turn allows the combined structure of the fork base top bar 250 and back carriage top bar 230 to have a smaller vertical dimension. The net result is less blocking of the view through the side shifter 210 for the driver of the lift truck. The back carriage top bar 230 is wider in the third embodiment than its counterpart in the second. This provides more protection for the piston rods 278, 280. However, the back carriage top bar 230 also extends the combined structure of the fork base top bar 250 and back carriage top bar 230 farther to the sides. This increases the portion of the view though the side shifter 210 that is blocked. However, the driver of the lift truck typically looks through the center, not through the sides of the side shifter 210, so this is not a significant detriment.

Unlike the second embodiment, the top bar bearings 270 in the third embodiment will limit the range of lateral motion of the fork base 222. In the second embodiment, the actuator 124 can move the fork base 122 until the end of the fork base top bar recess 156 contacts the actuator body 126. In the third embodiment, the actuator 224 can move the fork base 222 until the end of the fork base top bar recess 256 contacts one of the top bar bearings 270.

Fourth Embodiment

FIGS. 13-16 show a fourth embodiment of a side shifter apparatus 310. Like the side shifter in the first, second, and third embodiments, it is configured to be attached to a lift truck (not shown). The fourth embodiment side shifter apparatus 310 includes a back carriage 320, a fork base 322 and an actuator 324. The components of the fourth embodiment of the side shifter apparatus 310 are similar in structure and function to corresponding parts in the third embodiment, unless noted herein. The primary difference between the second and fourth embodiments being the placement and structure of bearings.

Similar to the third embodiment, in the fourth embodiment, the actuator 324 has an actuator body 326, a right piston rod 378, and a left piston rod 380. The actuator 324 is configured to move the right piston rod 378 and left piston rod 380 in tandem, applying more or less the same amount of force in the same direction to each. The internal workings of the actuator 324 are similar to those described in U.S. Pat. No. 5,807,060.

Similar to the third embodiment, in the fourth embodiment, the back carriage 320 has a top bar 330, bottom bar 332, right side bar 342 and left side bar 344. The side bars 342, 344 are configured to attach to the lift truck mast and provide a connection between the top bar 330 and bottom bar 332.

The back carriage top bar 330 is configured to receive the actuator body 326 and hold it in a fixed position relative to the back carriage 320. The back carriage top bar 330 has a recess 336 in its topside. The back carriage top bar recess 336 is concave and shaped to cradle the actuator body 326.

The back carriage top bar 330 has a right actuator retention tab 338 and a left actuator retention tab 340. These retention tabs 338, 340 hold the actuator body 326 in a fixed position so that it does not move relative to the back carriage 320.

The fork base 322 has a top bar 350, a bottom bar 352, a right bar 362, and a left bar 364. In its underside, the fork base top bar 350 has an actuator recess 356 (see FIG. 16), flanked on either side by bearing recesses 382, making the fork base top bar 350 generally channel-shaped with the open side of the channel facing downward toward the fork base bottom bar 352. The fork base top bar actuator recess 356 is concave and shaped to contain an upper portion of the actuator body 326. The actuator body 326 is not in direct contact with the fork base top bar 350. The fork base top bar actuator recess 356 is longer than the actuator body 326, allowing the actuator body 326 to move laterally within the actuator recess 356.

Figure 13:
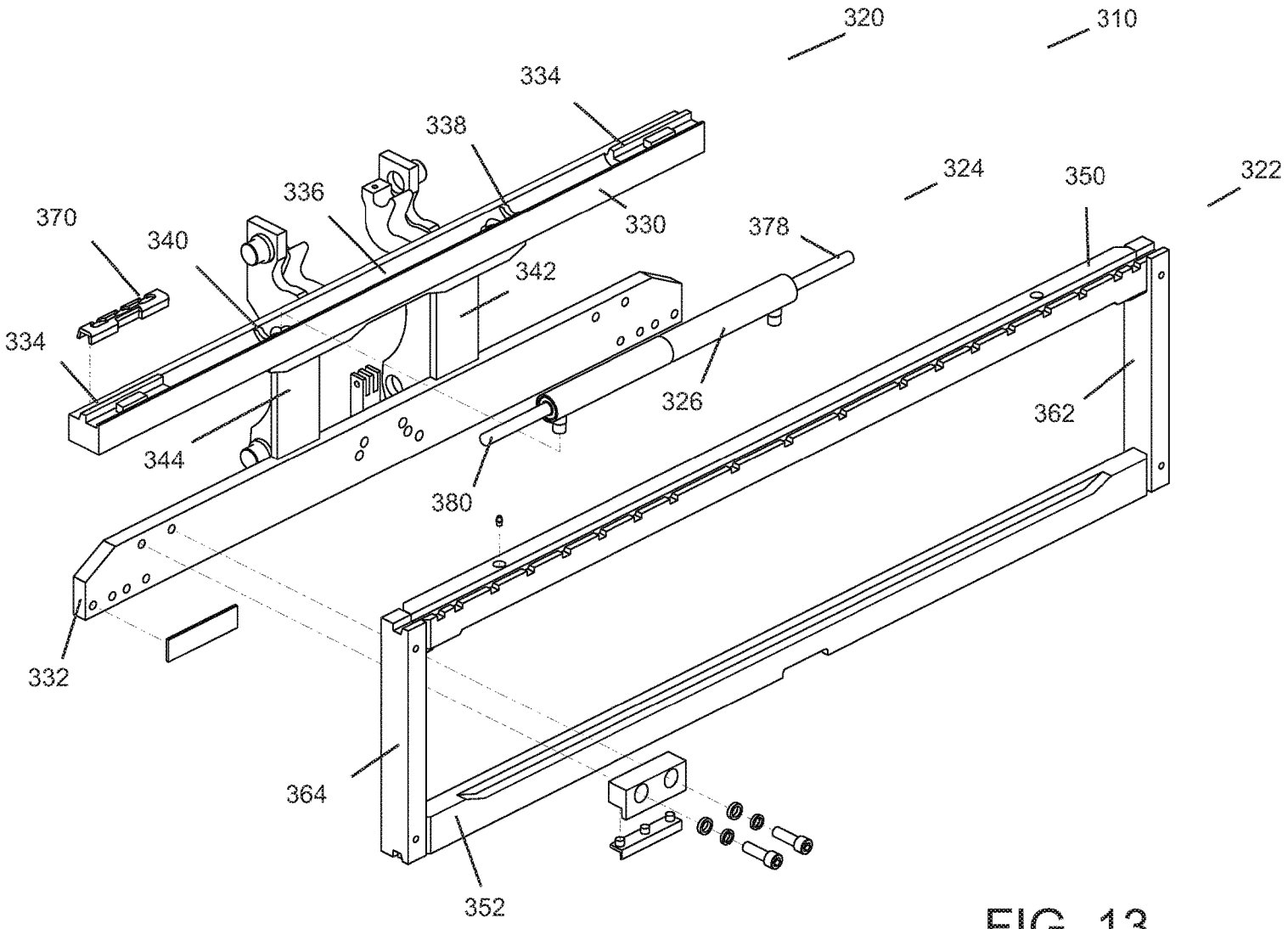
FIG. 13 is an exploded isometric front view of a fourth embodiment of the invention.
Figure 14:
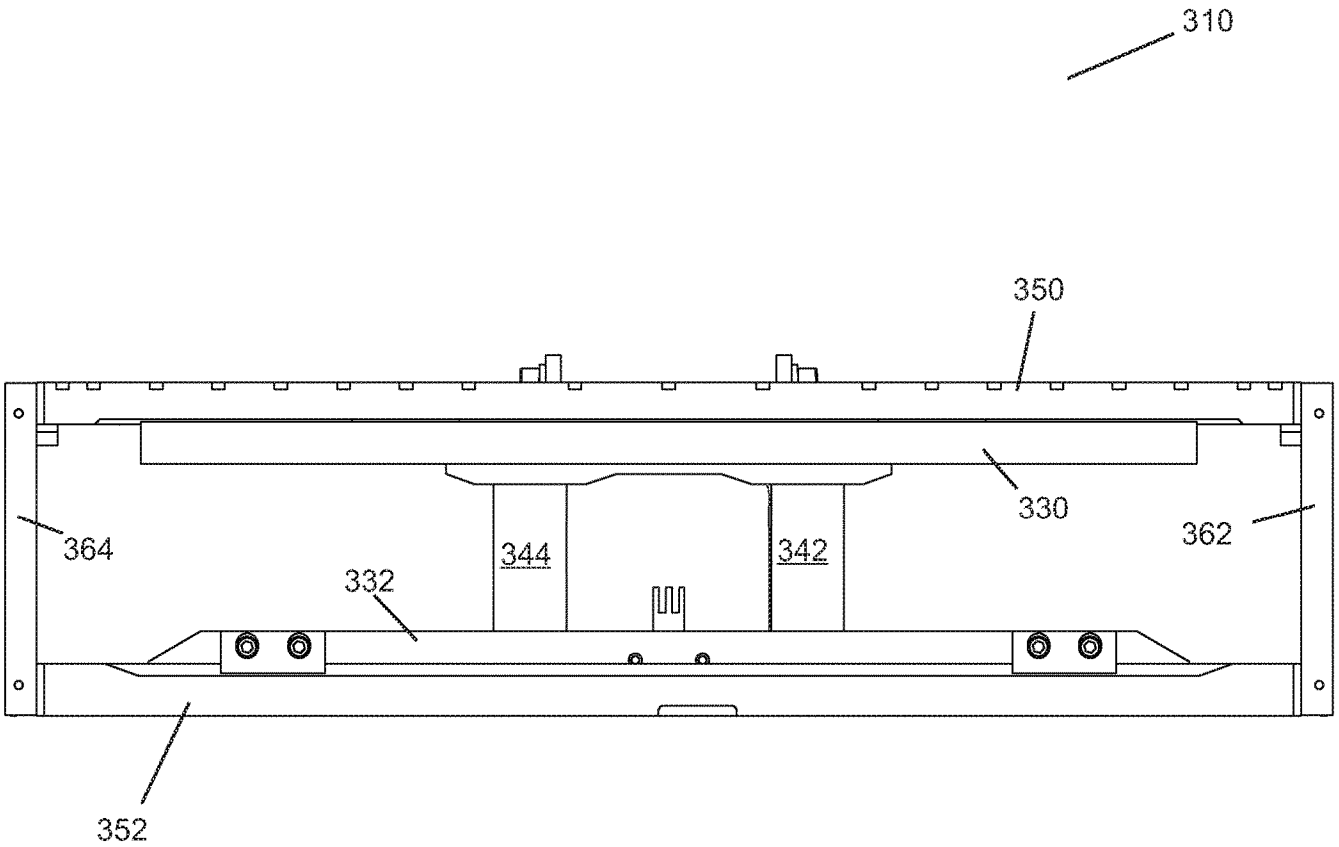
FIG. 14 is a front view of the fourth embodiment.
Figure 15:
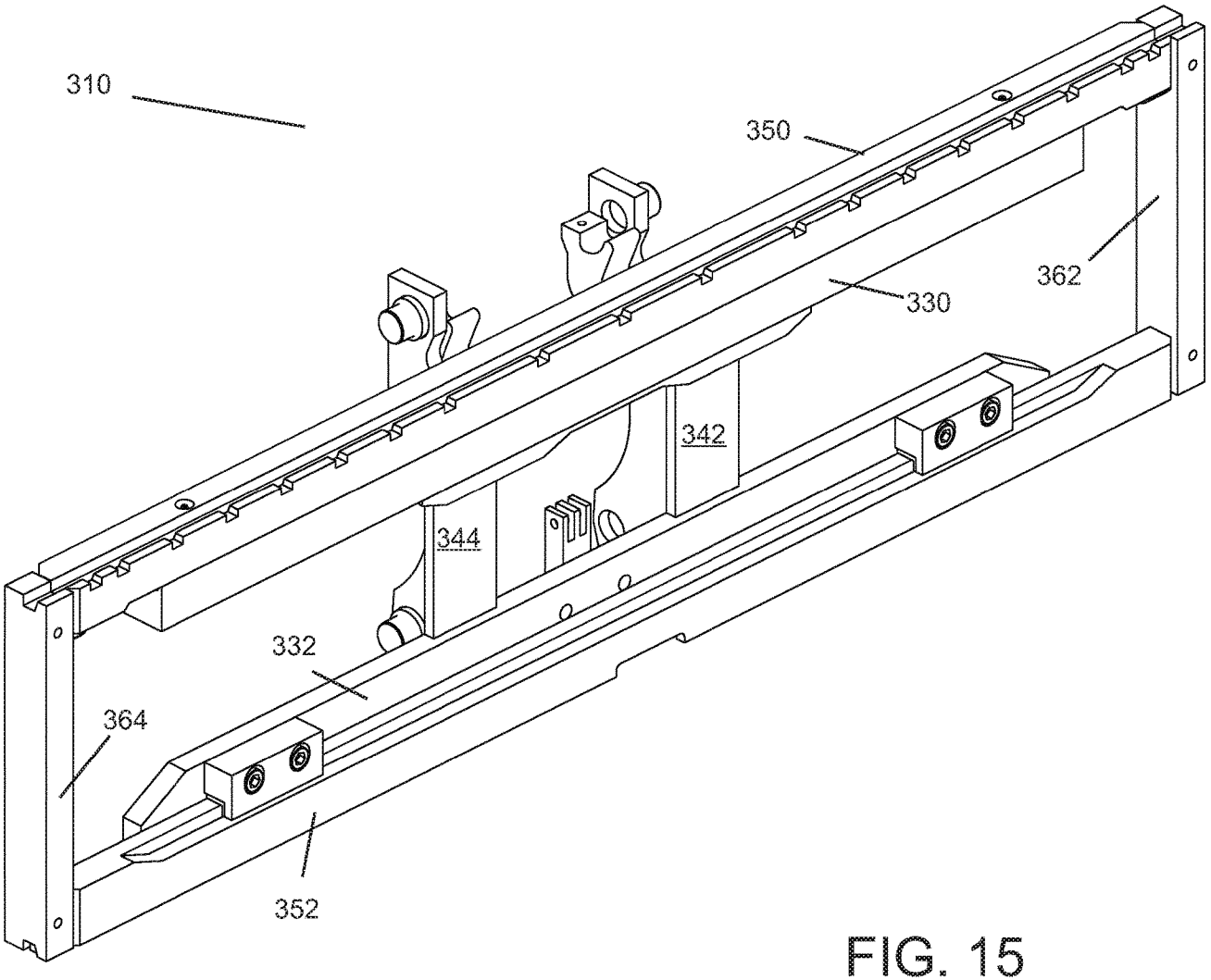
FIG. 15 is an isometric front view of the fourth embodiment.
Figure 16:
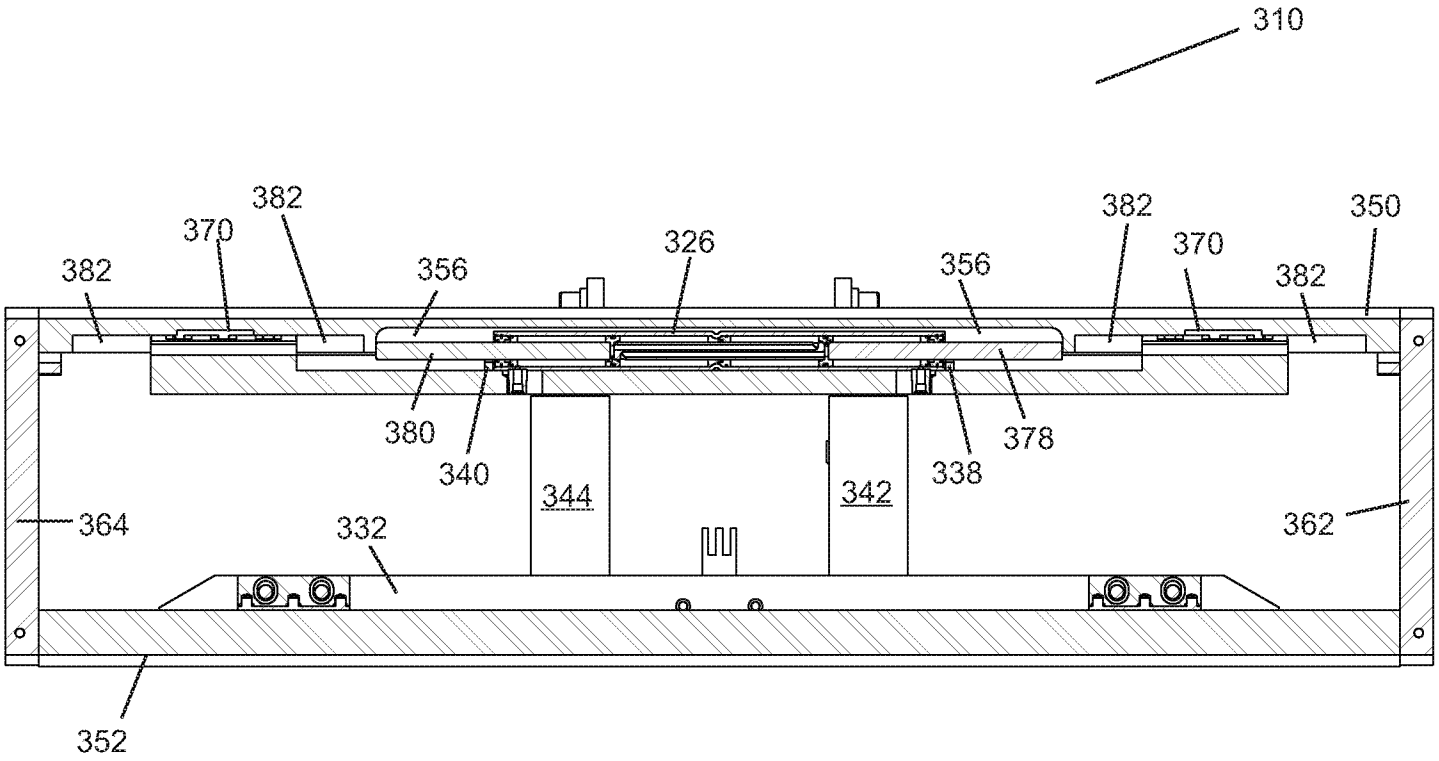
FIG. 16 is a cut-away front view of the fourth embodiment.

The fourth embodiment of the side shifter apparatus 310 has two or more top bar bearings 370, preferably two (only one is shown in FIG. 13 for clarity). The top bar bearings 370 are configured to fit in the fork base top bar bearing recess 382, at least one in each of the bearing recesses 382 on each side of the actuator recess 356. The top bar bearings 370 are placed on bearing retention tabs 334 of the back carriage top bar 330. The bearing retention tabs 334 hold the top bar bearings 370 in place so they do not move relative to the back carriage top bar 330 when the fork base 332 moves laterally across the top bar bearings 370. The one or more top bar bearings 370 are configured to transmit the force of a load from the fork base 322 to the back carriage 320 without transmitting any substantial part of the force of the load through the actuator body 326 or the piston rods 378, 380. The one or more top bar bearings 370 provide a sliding load-bearing contact to the fork base top bar 350. The one or more top bar bearings 370 comprise bearing material on their upper surfaces, and are backed by a layer of harder and stronger material.

Since unlike the second embodiment, the top bar bearings 370 in the fourth embodiment are not over the actuator body 326, the outside dimensions of the top bar bearings 370 may be smaller. This permits the fork base top bar bearing recess 382 to have smaller dimensions, which in turn allows the combined structure of the fork base top bar 350 and back carriage top bar 330 to have a smaller vertical dimension. The net result is less blocking of the view through the side shifter 310 for the driver of the lift truck using it. The back carriage top bar 330 is wider in the fourth embodiment than its counterparts are in the second and third embodiments. In the fourth embodiment, piston rods 378, 380 are completely, or at least substantially, enclosed within the combined structure of the fork base top bar 350 and back carriage top bar 330, even when the fork base 322 has been shifted to its side as far as it will go. However, the wider back carriage top bar 330 also extends the combined structure of the fork base top bar 350 and back carriage top bar 330 to the sides even more than in the third embodiment. This increases the portion of the view though the side shifter 310 that is blocked. However, the driver of the lift truck typically looks through the center, not the sides of the side shifter 310, so this is not a significant detriment.

The top bar bearings 370 in the fourth embodiment will limit the range of lateral motion of the fork base 322. The actuator 324 can move the fork base 322 until an end of the fork base top bar bearing recess 382 contacts one of the top bar bearings 370.

Those skilled in the art will recognize that numerous modifications and changes may be made to the various embodiments without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the first embodiment is essential. Other embodiments are possible, their specific designs depending upon the particular application. As such, the scope of the invention should not be limited by the particular embodiments herein described but should be defined only by the appended claims and equivalents thereof.

What is claimed is:

1. A side shifting apparatus comprising:

a back carriage configured to attach to a lift truck, the back carriage having a back carriage top bar with a back carriage top bar recess in a topside of the back carriage top bar;

a fork base having a fork base top bar with a fork base top bar recess in an underside of the fork base top bar, wherein the fork base top bar is positioned on top of the back carriage top bar;

an actuator with an actuator body, wherein the actuator body is positioned within the back carriage top bar recess and the fork base top bar recess, wherein the actuator is configured for moving the fork base laterally relative to the back carriage; and one or more top bar bearings coupled to the back carriage top bar and positioned between the actuator body and the fork base top bar, wherein the one or more top bar bearings provide a sliding surface for the fork base top bar.

2. The side shifting apparatus of claim 1, further comprising:

wherein the one or more top bar bearings are configured to transmit a force of a load from the fork base to the back carriage without transmitting any significant part of the force of the load through the actuator body.

3. A side shifting apparatus comprising:

a back carriage configured to attach to a lift truck, the back carriage having a back carriage top bar with a back carriage top bar recess in a topside of the back carriage top bar;

a fork base having a fork base top bar with a fork base top bar recess in an underside of the fork base top bar, wherein the fork base top bar is positioned on top of the back carriage top bar;

an actuator with an actuator body, wherein the actuator body is positioned within the back carriage top bar recess and the fork base top bar recess, wherein the actuator is configured for moving the fork base laterally relative to the back carriage, wherein the actuator has a right piston rod and a left piston rod; and further compromising two or more top bar bearings coupled to the back carriage top bar, at least one top bar bearing positioned to the right of the actuator body over the right piston rod, at least one top bar bearing positioned to the left of the actuator body over the left piston rod, wherein the two or more top bar bearings provide a sliding surface for the fork base to bar.

4. The side shifting apparatus of claim 3, wherein the two or more top bar bearings are configured to transmit a force of a load from the fork base to the back carriage without transmitting any significant part of the force of the load through the actuator body.

5. A side shifting apparatus comprising:

a back carriage configured to attach to a lift truck, the back carriage having back carriage top bar with a back carriage top bar recess in a topside of the back carriage top;

a fork base having a fork base top bar with a fork base top bar recess in an underside of the fork base top bar, wherein the fork base top bar in positioned on top of the back carriage to bar;

an actuator with an actuator body, wherein the actuator body is positioned within the back carriage top bar recess and the fork base top bar recess, wherein the actuator is configured for moving the fork base laterally relative to the back carriage, wherein the actuator has a right piston rod and a left piston rod; and further comprising two or more top bar bearings coupled to the back carriage top bar, at least one top bar bearing positioned to a right of the right piston rod, at least one top bar bearing positioned to a left of the left piston rod, wherein the two or more top bearings are configured to transmit a force of a load from the fork base to the back carriage without transmitting any significant part of the force of the load through the actuator body, wherein the two or more top bar bearings provide a sliding surface for the fork base top bar.

* * * * *